US006253586B1

(12) United States Patent
Lai

(10) Patent No.: US 6,253,586 B1
(45) Date of Patent: Jul. 3, 2001

(54) APPARATUS AND METHOD FOR PROCESSING FABRIC

(76) Inventor: David Lai, 220 S. Linden Ave., South San Francisco, CA (US) 94080

( * ) Notice: Subject to any disclaimer, the term of this patent is extended or adjusted under 35 U.S.C. 154(b) by 0 days.

(21) Appl. No.: 09/298,937

(22) Filed: Apr. 24, 1999

(51) Int. Cl.[7] ..... D06F 29/02; D06F 37/28; D06F 37/30

(52) U.S. Cl. ..... 68/26; 68/23 R; 68/140; 68/144; 68/171; 68/210; 68/27

(58) Field of Search ..... 68/23.1, 23 R, 68/25, 26, 27, 140, 144, 171, 210

(56) References Cited

U.S. PATENT DOCUMENTS

| | | | | |
|---|---|---|---|---|
| 2,255,028 | * | 9/1941 | Long | 68/144 X |
| 2,520,685 | * | 8/1950 | Horvath | 68/173 X |
| 3,321,941 | * | 5/1967 | Ellis | 68/140 X |
| 3,844,142 | * | 10/1974 | Miller | 68/210 X |
| 4,195,498 | * | 4/1980 | Pellerin | 68/210 X |
| 5,090,220 | | 2/1992 | Fukuzawa | 68/3 R |
| 5,205,141 | | 4/1993 | Singh | 68/53 |
| 5,450,733 | | 9/1995 | Kim | 68/355 |
| 5,461,886 | | 10/1995 | Kim | 68/355 |

FOREIGN PATENT DOCUMENTS

| | | | | |
|---|---|---|---|---|
| 67090 | * | 6/1969 | (DE) | 68/23.1 |

* cited by examiner

*Primary Examiner*—Philip R. Coe
(74) *Attorney, Agent, or Firm*—Robert Samuel Smith

(57) ABSTRACT

An apparatus for a large throughput fabric processing operation including a conveyor belt passing under a row of washers and having an extraction (spinning) apparatus at the end of the belt. The production line involves top loading each washer as required and dumping the batches of fabric on the belt after completing the washing step. The extraction step involves varying the rate of spin and the tilt of the extraction cyclinder in order to maintain an even distribution of fabric and then rocking the extractor to loosen the load from the inside surface of the extractor. Processing oprations to which this invention may be applied include, laundering, dyeing and drycleaning.

24 Claims, 7 Drawing Sheets

LOAD AVAILABLE WASHER

ADD WASH WATER

AGITATE TUB FOR WASH CYCLE

DRAIN WASH WATER

ADD RINSE WATER

AGITATE TUB FOR RINSE CYCLE

DRAIN RINSE WATER

STOP BELT

OPEN TRAP DOOR

SEND WASHER AVAILABLE SIGNAL TO CONTROLLER

CONFIRM THAT EXTRACTOR IS EMPTY

MOVE CONVEYOR BELT TO LOAD ELEVATOR

LIFT LAUNDRY ON ELEVATOR

DUMP LAUNDRY LOAD INTO EXTRACTOR

SPIN TO EXTRACT AND DRAIN WATER

ROCK THE EXTRACTOR TO LOOSEN LOAD FROM EXTRACTOR

TILT EXTRACTOR TO DUMP LAUNDRY LOAD

SEND "EXTRACTOR AVAILABLE SIGNAL TO CONTROLLER"

FIG. 6

APPARATUS AND METHOD FOR PROCESSING FABRIC

FIELD OF THE INVENTION

This invention relates to an apparatus and method for a process which involves a first step of soaking the fabric in a liquid and extracting the liquid from the fabric preparatory to drying the fabric. Such processes include washing laundry, drycleaning garments, dying fabric and other processes involving the use of fluids such as certain processes that involve the use of loquid $CO_2$. The invention relates particularly to one or more washers used in the soaking step which feature techniques that conserve energy and provide enhanced throughput and to an extractor that overcomes problems associated with the high speed of spinning used in state of the art extraction equipment.

PRIOR ART AND INFORMATION DISCLOSURE

Processing of fabric in a laundering, drycleaning or dying operation involves several steps. The fabric is loaded into a washer where it is thoroughly soaked (washed) by agitation in an appropriate solution (e.g., soapy water, drycleaning chemical, or dye). Then fabric is subject to an extraction step (frequently spinning) where excess liquid is removed preparatory to going into a drying step.

In a laundering process, the washer step involves agitating the laundry first in soapy water draining the soapy water, agitating the laundry in rinse water, draining the rinse water, and then extracting water.

Efforts to improve the efficiency of laundering fabric has resulted in numerous design approaches.

For example, U.S. Pat. No. 5,090,220 to Fukuzawa et al discloses a perforated washing tub mounted concentrically in an outer tub which can be inclined together by a tub tilting mechanism. A reciprocally rotating pulsator is provided in the lower region of the washing tub so that the laundry can be washed using by the combined motion of the tilting and rotating mechanisms fragile clothing can be washed by the gentle motion of the tilting mechanism alone. Rib-like lifters are provided for rotating the laundry load during the drying step.

U.S. Pat. No. 5,205,141 to Singh discloses a reciprocating laundry basket for an automatic -washer and having a central post mounted within the basket for rotation with the basket. A spray device is mounted on the post for spraying wash liquid into the interior of the basket. Vertical fins are provided within the basket to enhance agitation of the fabric load.

Neither concept of Singh nor Fukuzawa is amenable to energy conservation nor does it address the problem of large continuous throughput that would be advantageous for commercial application.

U.S. Pat. No. 5,450,733 to Kim et al discloses a washing machine including a tab and a disk mounted adjacent and parallel to the bottom of the tub Both the tub and disk have vibrational modes, each characterized by a fundamental frequency. A flexible elastic body between the the disc and inner bottom of the washing tub which equalizes the fundamental frequencies of the tub and disk so as to conserve the energy of resonant vibration.

U.S. Pat. No. 5,461,885 to Kim et al discloses a sponge-like shield between a pulsating disk and inner wall of the washing tub of a washing machine which enhances resonant vibration to conserve energy and also to prevent jamming of clothing between the disk and inner surface of the tub.

The disclosures of Kim rely on the "stiffness" properties of water to couple the vibrational mode of the disk to the vibrational modes of the rest of the washing machine and therefore would not be as effective as contemplated by the present invention. Neither does Kim address the problem of large throughput as an important object of a commercial laundering operation.

SUMMARY OF THE INVENTION

It is an object of this invention to provide a fabric processing system that is a continuous operation inherently adaptable to meet large scale commercial requirements wherein the principles of the method and apparatus is applicable to washing laundry, drycleaning garments, dying fabric.

It is a further object that the steps in the process be characterized as conserving energy more effectively than present state of the art systems.

It is yet another object to compartmentalize separately by components the steps of washing and extracting whereby the design of each component can be optimized for performing its intended function and the number of components for each step can be selected in relation to the number of components of the other steps so that each component is utilized a maximum length of time. For example, the extraction step requires only a fraction of the time required for the washing step. Therefore the system is readily adapted to incorporating more washing components than extracting components so that both the washing and extracting components are used all of the time.

This invention is directed toward a conveyor system wherein separate washing stations are are especially constructed to feed to the conveyor separate loads which are then delivered to a common extraction station.

The fabric is top loaded into the washers and discharged out of the bottom of the washers which has important advantages over present apparatus that loads and unloads by tilting the washer.

The tub has a bottom door which opens when the washing and rinse cycle are complete dumping the damp clean laundry onto a moving conveyor belt. The conveyor belt passes under a plurality of the wash stations described above. Each wash station dumps its laundry load under control of a detection device that prevents mixing loads. At the end of the conveyor travel, each load is dumped onto an elevator which lifts the load from the conveyor and dumps it into the top open top end of a spin extractor. When the spin extraction operation cycle has been completed, the spin extractor is tipped so as to discharge the load in preparation for the next load.

A feature of this invention is a construction of each of the washers that minimizes the amount of energy required to perform the wash and rinse cycle. The energy conserving characteristic is based on a unique agitating mechanism of each washing station that conserves the energy of motion that is generated by the agitation action. Each wash station includes a tub that is suspended to rotate about a horizontal shaft perpendicular to the axis of the tub. Liquid for washing and rinsing is admitted to the top end of the tub and spent solution is drained through a sieve from the bottom. The agitating mechanism includes a drive connected to the tub through a lever. The ends of the shaft supporting the tub are coupled to ground by a pair of air cushions having stiffness automatically adjusted to reinforce the resonant oscillatory motion of the rocking tub.

The extractor of this invention features spinning each load in a succession of spin rates where the axis of spin is tilted horizontally and spun at a low rate in order to evenly distribute the load and then oriented vertically and spun at a high rate thereby avoiding the vibration problems caused by uneven load distribution associated with state of the art extractors.

BRIEF DESCRIPTION OF THE DRAWINGS:

FIG. 6 shows the flow chart for the washing and extracting process.

DISCUSSION OF A BEST MODE

Figure 1:
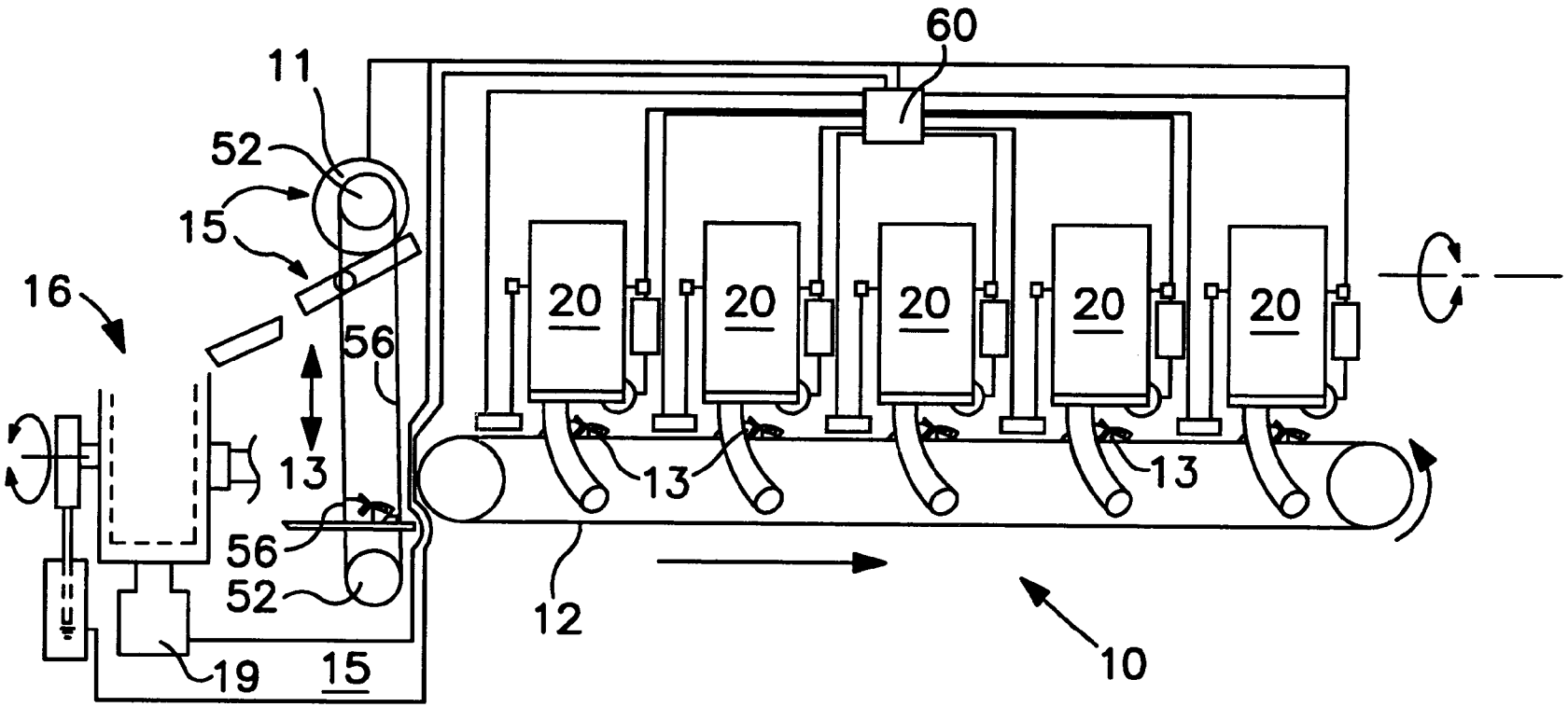
FIG. 1 is a mechanical schematic diagram of the fabric processing apparatus of this invention.

Turning now to a discussion of the drawings, FIG. 1 shows a mechanical schematic diagram of the apparatus 10 of this invention including a conveyor belt 12 which accepts laundry loads 13 from four washer stations 14 and delivers the laundry loads 13 to an elevator 15. The elevator 15 dumps each laundry load 13 into the top open end of an extractor 16 which extracts water by spinning each load 13 separately, one at a time. As the extractor 16 finishes with each load 13, the load 13 is dumped from the extractor 16 and delivered to a drying operation (drying operation not shown).

Figure 2:
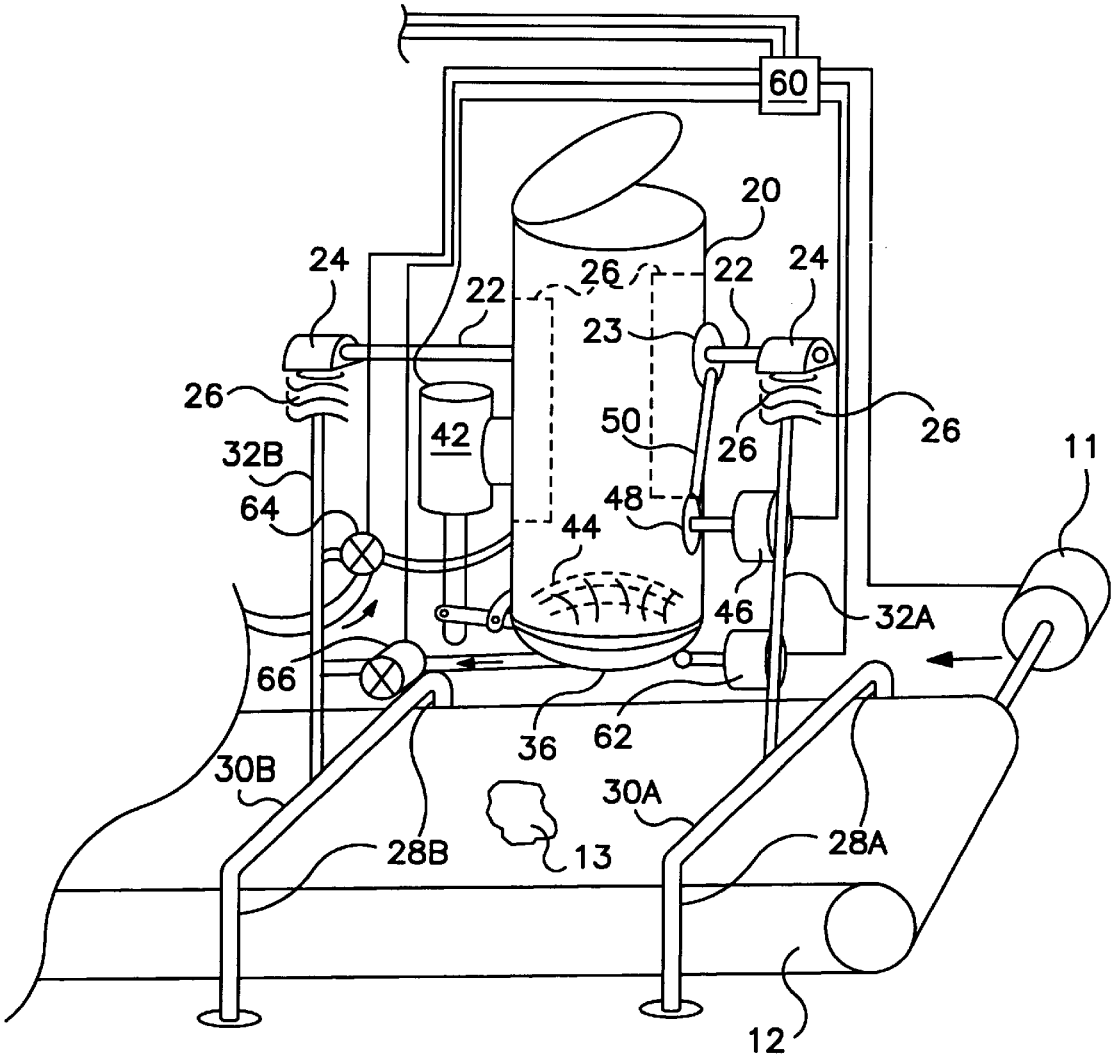
FIG. 2 shows the washing station.

FIG. 2 shows the washing machine of this invention in greater detail. There is shown a cylindrical washing tub 20 which has radial vanes 21 formed integrally with the interior surface of tub 20. The vanes have apertures which generate bubbles as the tub 20 turns and aids in dislodging soil. The tub is rotatably supported by two opposing aligned shafts 22 to oscillate about an axis intersecting and perpendicular to the axis of the tub. Each rocking shaft 22 is journaled into pillow bearing 24. Each pillow bearing 24 is mounted by air cushions 26 on the top end of a frame 28.

Figure 5:
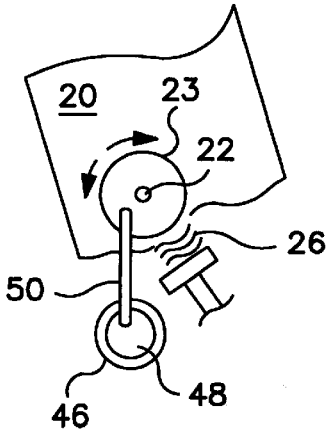
FIG. 5 shows the rocker mechanism.

The agitation mechanism for rocking the washer tub is shown to best advantage in FIG. 5 Agitation of the laundry load is accomplished by agitator drive 46 driving a crank wheel 48 that is coupled by lever 50 to a lever wheel 23 that is rigidly mounted on the side of tub 20. Agitator drive 46 is also mounted on a vertical tub leg 32A of the main frame.

Figure 11:
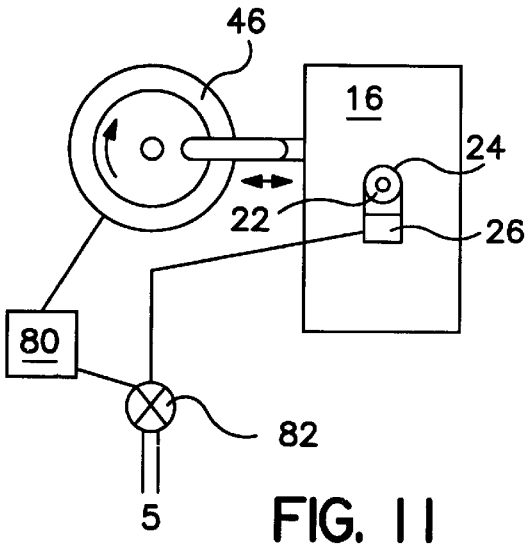
FIGS. 11–11A shows an arrangement for computer controlled adjustment of air pressure of the air cushions.
Figure 10D:
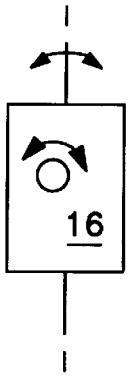
Figure 11A:
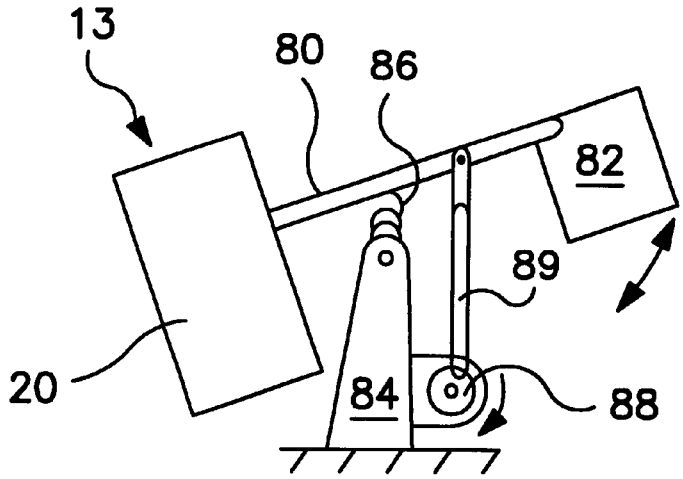
Figure 12:
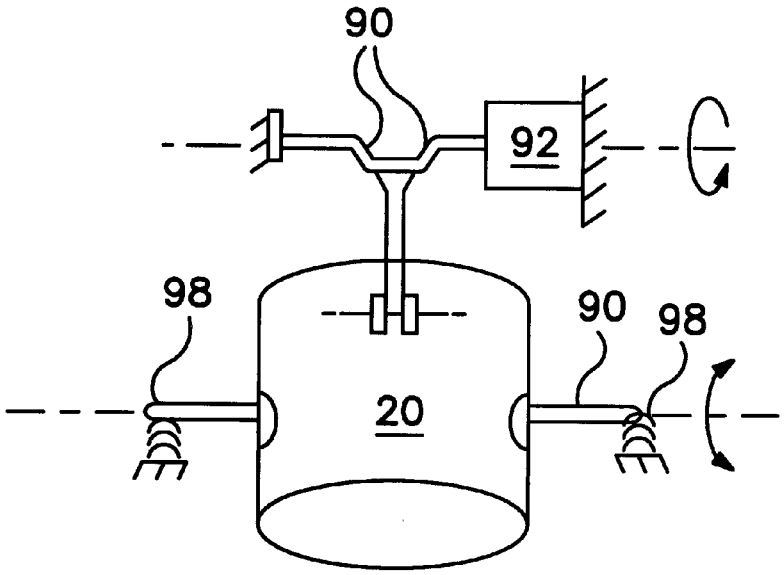
FIG. 12 show alternate arrangements for agitating (rocking) the tub.

An important feature of this invention is the selection of the stiffness constant of the air cushions 26 by adjusting the air pressure of the air cushions 26 in combination with the angular moment of inertia of the tub oscillating about shafts 22 to establish resonant rocking motion of the tub thereby reducing the amount of energy required to agitate the laundry load. One means for minimizing the energy requirement for agitating the laundry is illustrated in FIG. 11 where the drive 46 is a motor coupled to washer tub 20 by a crank.

The tub is supported by shafts 22 resting on air cushions 26. Pressurized air is supplied to the cushion 26 from a source (not shown) through valve 82 which is adjusted by a controller 80. The controller electronically measures the current input to the agitator drive 46 as the pressure in the air cushions is increased until a minimum value of current input is detected.

Figure 8:
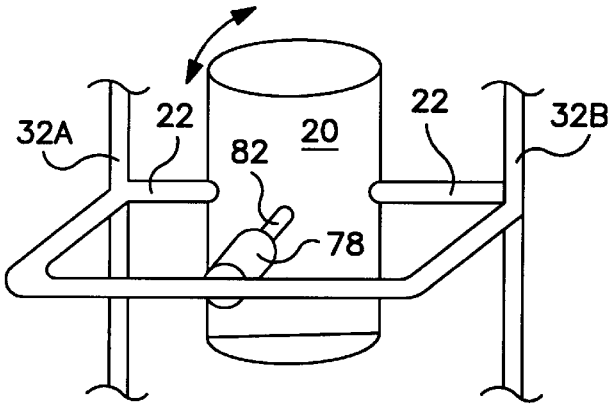
FIG. 8 shows an alternate arrangement for agitating the load.

FIG. 8 shows another agitating mechanism including a drive 78 mounted on a brace 80 that straddles the midriff of the basin and is mounted on legs 22. The drive is a pneumatic cylinder mounted on brace 80 and has a reciprocating piston arm 82 engaging the side of tub 20.

FIG. 2 shows the conveyor belt 12 (partially cutaway) driven by conveyor belt drive 11.

The main frame includes two pairs of upright base legs 28A and 28B. The top ends of each pair of base legs 28A,B are joined by a horizontal joining leg 30 A, B. Tub support legs 32A and 32 B extend vertically and the upper ends of vertical tub support legs 32A and 32B each support one of air cushions 26.

Each pair of base legs 28A and 28B straddle conveyor belt 12 so that belt 12 moves under each of the washing machines 14 as shown in FIG. 1.

Each washing machine 14 has a bottom trap door 36 that swings open at the completion of a wash-rinse cycle permitting the laundry load to fall as a pile on conveyor belt 12.

Figure 4:
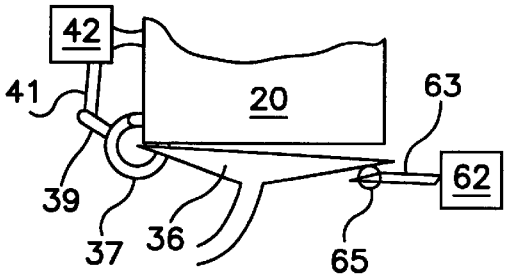
FIG. 4 shows the mechanism for closing and clamping the trap door in the washer.

The open-close and clamp mechanism of the trap door is shown to best advantage in FIG. 4 The clamp is a special feature of this invention which is a precaution to prevent leakage from out of the trap door. There is shown the trap door 36 hingably mounted on the side of tub 20. A lever arm 39 has one end mounted on hinge 37. The other end of lever arm 39 engages the arm 41 of trap door drive 42. When trap door drive 42 drives lever arm 41, the trap door 36 swings shut. Then clamp drive 62 drives the roller end 65 of clamp rod against the trap door 36 as a further precaution to clamping trap door 36 completely shut.

Figure 7A:
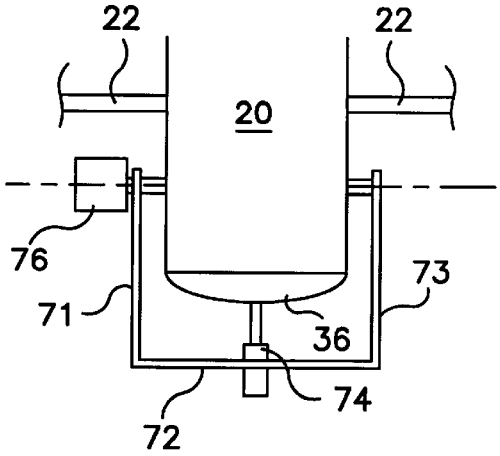
FIGS. 7A–C show the bottom trap door construction.
Figure 7B:
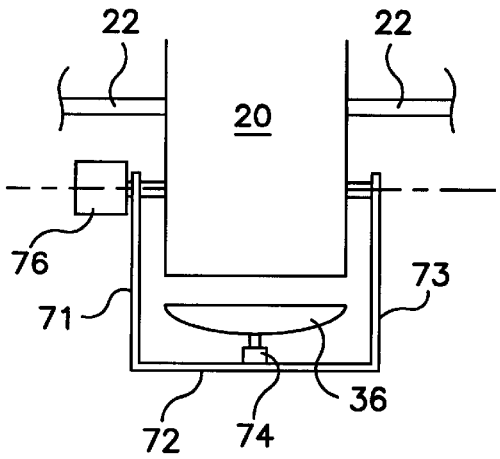
Figure 7C:
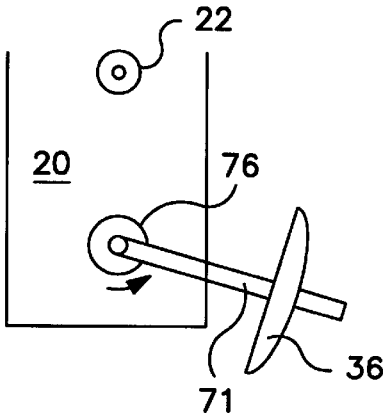

FIGS. 7A–C show another embodiment of the trap door opening-closing mechanism. There is shown a yoke including vertical legs 71 and 73 joined by joining leg 72., The upper ends of legs 71 and 73 are rotatably joined to the side of the tub 20. Pneumatic cylinder 74 is mounted on joining leg 72 and forces door 36 into sealing contact with the door opening of tub 20. As shown in FIG. 7B, in order to open trap door 36, the plunger of pneumatic cylinder 74 is retracted allowing trap door 36 to drop down away from the opening of trap door 36. As shown in FIG. 7C, the door 36 is finally swung away to permit laundry to fall out of tub 20.

A screen 44 is supported by trap door 36 inside tub 20 and permits water from the wash and rinse cycles to drain from inside the tub 20 through a drain 46 when required. The screen 44, being supported by trap door 36 swings open when door 36 opens permitting the laundry load to drop out of the tub 20 onto the belt 12.

Figure 3:
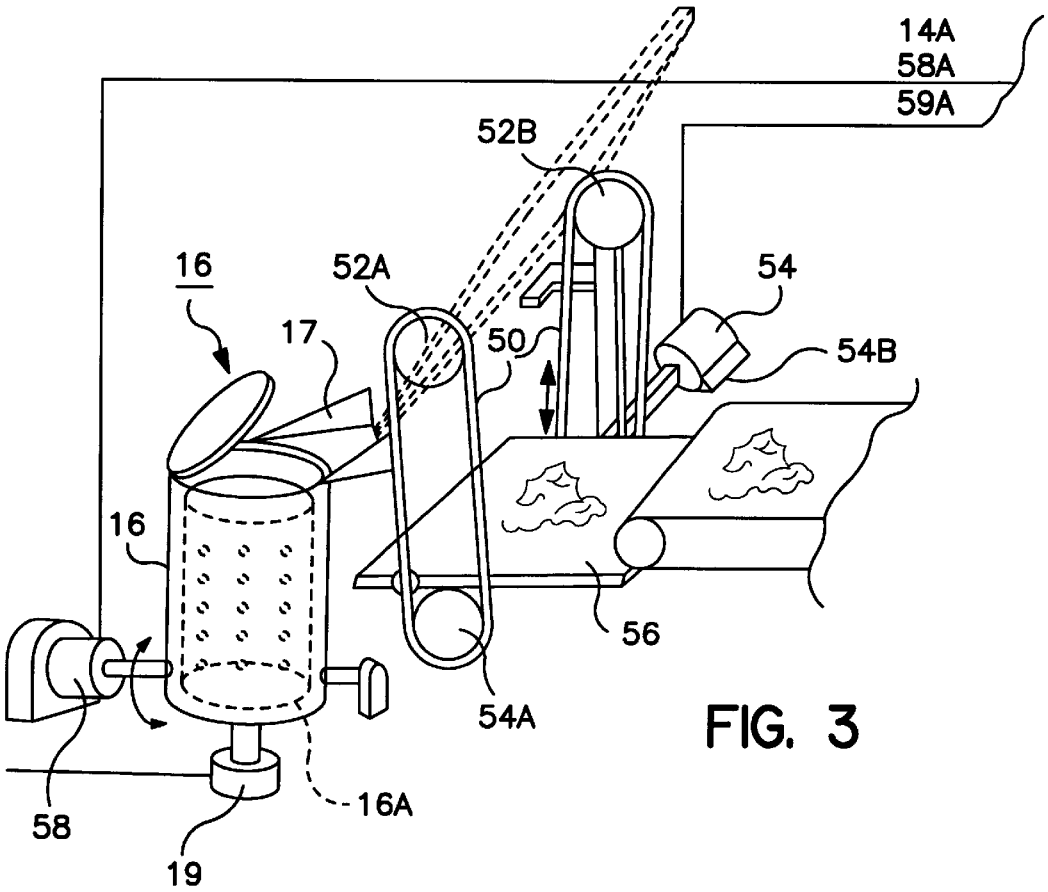
FIG. 3 shows the extractor station.

The laundry loads 13 are carried to the end of the conveyor 12 and deposited in the extractor 16 by elevator 15. FIG. 3 shows the extractor 16 and elevator 15 in greater detail mounted on frame 29. The elevator comprises a pair of belt loops 50, each loop 50 being mounted on a pair of pulley wheels, one wheel 52 A or 52B of each pair mounted on the frame vertically above the other pulley wheel 54A or 54B and each pair of pulley wheels 52A, 54A being on one side of the conveyor belt 12 opposite the other pair of pulley wheels. Edges of tray 56 are attached to the belt loops 50 so that the tray 56 extends horizontally from the end of conveyor 12. The tray 56 is initially positioned below the end of the conveyor 12 so that the laundry load 13 reaching the end of the conveyor belt 12 drops off the end of the conveyor 12 onto the tray 56. Elevator drive 58 turns on to drive belt loops 50 and lift tray 56 to a height where the tray is tripped (shown in phantom) and the load is dumped into the extractor 16 guided by chute 17.

Figure 9:
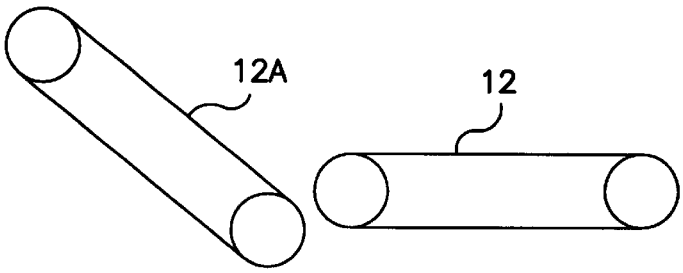
FIG. 9 shows an alternate elevator construction
Figure 10A:
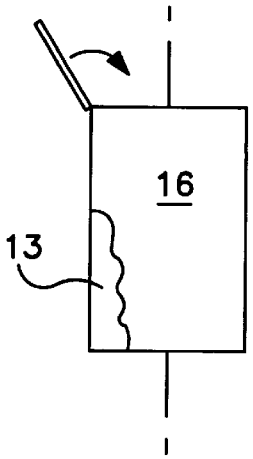
FIGS. 10A–E show the variation of tilt of the extractor during the extraction step.
Figure 10B:
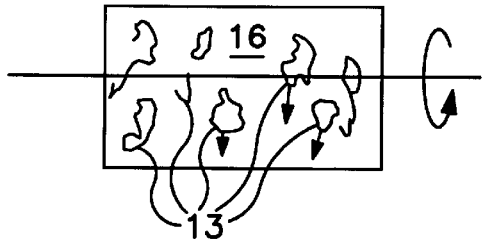
Figure 10C:
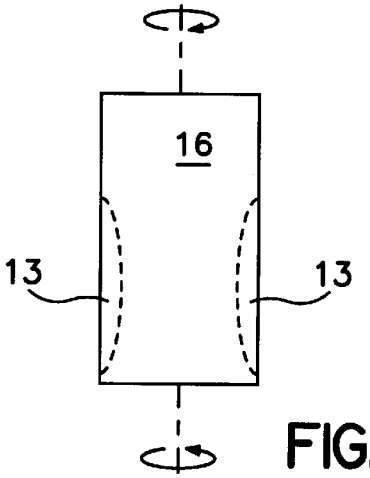
Figure 10E:
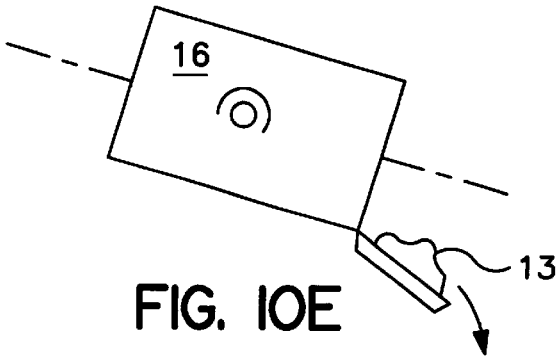

FIG. 9 shows another embodiment in which the elevator is simply an inclined belt section 12A.

The extractor 16 includes a perforated cylindrical inner basin 16A rotatably mounted concentrically inside outer cylindrical basin 16B In the water extraction process, the perforated basin 16A is rotated at high speed by spin drive 19 and water is spun out of the laundry load by centrifugal force, passes through the perforated inner basin and out through drain.

At the end of the extraction cycle, dump drive 58 turns on to dump the laundry load out of the extractor.

FIG. 10 A–*d* illustrates four steps in an extraction cycle that is another feature of the invention. This feature overcomes the problem with state of the art extractors that results from uneven distribution of the laundry in the extractor and causes severe vibration and inefficient extraction during the spinning of the extractor.

According to this feature, in the first step (FIG. 10A), the centerline of the cylindrical extraction basin is vertical while the wet laundry is loaded into the extractor basin.

In the second step (FIG. 10B), the centerline of the extraction basin is oriented horizontally and the basin is spun at a speed slow enough so that the force of gravity overcomes the centrifugal force of the spin allowing the laundry to be distributed evenly around the inner surface of the basin. Sufficient water is retained or added in this step as an aid for distributing and balancing the load.

In the third step (FIG. 10C), the centerline of the basin is oriented vertically and the basin is spun at a rate great enough (typically, 700 rpm) to extract water from the laundry.

In the fourth step, (FIG. 10D)the basin is rocked back and forth to loosen the load from the inside surface of the basin.

In the fifth step (FIG. 10E), the laundry is dumped from the extractor by tipping the basin.

Referring again to FIG. 2, a controller 60 is shown connected to the trap door drive 42, clamp drive 62, and agitator drive 42 as well as the conveyor belt drive 11. The controller is also connected to water inlet valve 64 and water drain valve 66. While the controller 60 is shown connected only to one washer station in FIG. 2 it will be understood that the controller has parallel connections to each of the washer stations as shown in lesser detail in FIG. 1. The controller 60 is also connected by lines to drives of the elevator 15, extractor 16 as shown in FIG. 3 to include elevator drive 59, dump drive 58 and spin drive 19.

FIG. 6 is a flow chart listing the steps in the laundry washing process of this invention.

In step 1, load laundry in available washer 20.

In step 2, open valve 64 of the available washer to add wash water.

In step 3, activate the tub activator drive 46 of the available washer.

In step 4, open drain valve 66 to drain wash water from available washer.

In step 5. open valve 64 of the available washer to add rinse water.

In step 6, agitate tub to add rinsing.

In step 7, open drain valve 66 to drain rinse water from available washer.

In step 8, stop belt drive 11 when space on belt beneath available washer is empty.

In step 9, Actuate trap door drive 42 and clamp drive 62 to open bottom door of available washer and dump load on belt.

In step 10 send "washer available signal to controller.

In step 11 confirm from controller that extractor is empty.

In step 12 Actuate belt drive 11 to move belt until laundry load falls on elevator section.

In step 13 actuate elevator drive 59 to lift elevator section holding laundry load.

In step 14 When elevator section lifts the laundry load above the open extractor, dump laundry load into extractor 16.

In step 15 actuate spin drive 19 to extract water.

In step 16, activate dump driv 58 to rock the extractor to shake the load loose In step 16 activate dump drive 58 to empty extractor.

In step 17, send signal to controller to start belt and reload extractor.

There has been described a laundry process and apparatus that is especially adaptable to industrial applications where maximum use of each component (washing and extracting) is desired in order to maximize the throughput volume.

The invention is also characterized as being a very low cost operation, low energy expenditure is inherent in the design of the apparatus to conserve the energy of agitation of the tub during the wash cycle by judicious selection of the restoring constant of the supporting air cushions in combination with the moment of inertia of the rocking tubs.

The apparatus is also amenable to use in a serial washing process where, for example, rinse discharged from one washer is used as the wash water of the next wash cycle. This practice would be especially economical where the laundry load is initially very dirty.

The apparatus is also amenable to reusing the wash water and/or rinse water by storing the wash and/or rinse water temporarily in one or more tanks between laundry batches.

Variations and modifications of the invention may be contemplated which are within the scope of the invention.

For example, each of the drives, agitator drives 46, clamp drive 62, trap door drive 42 elevator drives 58 and dump drive 58 may be any one of a motor drive, solenoid drive, pneumatic or hydraulic drive although by using motor drives for all of these drives and including the belt drive 11 and spin drive 19 simplifies the situation since only electrical power is required as compared, for example to the use of, pneumatic drives where the addition of a source of compressed air is required.

Various means of agitation are contemplated which are within the scope of the invention.

FIG. 11 shows another means of agitation in which the tub 20 is secured to one end of a lever 80 and a weight 82 which is selected to balance the tub 20 is secured tot he opposite end of the lever 80. The lever fulcrum is an air cushion 86 sitting on base 84. The lever is coupled by arm 89 to a motor drive 88 and so that the tub 20 oscillates up and down (arrow B).

FIG. 13 shows another arrangement for oscillating the tub including a crank 90 driven by drive motor 92 coupled by arm 94 to the side of the tub 20 so that the tub 20 rocks onshaft 96 supported by air cushions 98.

Principles of the invention may be adapted to a number of processes involving fluids such as a drycleaning process that uses liquid other than water.

In view of these and other considerations, I therefore wish to define my invention by the appended claims.

I claim:

1. An apparatus for processing fabric including a washing step with a process liquid and an extraction step for extracting said process liquid, which comprises:

at least one washer, each said at least one washer operably constructed for washing and rinsing said fabric in said process liquid;

said at least on washer including:

(a) a tub having a plurality of internal perforated vanes;

(b) an entry valve arranged for admitting process liquid into said tub;

(c) an exit valve arranged for discharging said process liquid from said tub, (d) an agitator means for agitating said batch of fabric in said tub, (e) a top entrance for loading a batch of fabric and a bottom exit for unloading said batch of fabric;

an extractor operably constructed to extract water from said batch of fabric discharged from any one of said washers;

a conveyor belt means arranged for transferring said batch of fabric from any one of said washers to said extractor, a frame operably arranged to support said at least one washer, said extractor, and said conveyor belt means, said tub having a bottom exit adjacent to and above said conveyor means;

a trap door;

means for supporting said trap door in a closed position against said [opening] bottom exit for retaining said batch of fabric in said tub and in an open position for enabling said batch of fabric to fall from said tub through said opening onto said conveyor means.

2. The apparatus of claim 1 which further comprises:

said trap door being responsive to an open signal;

a controller arranged for sending an open signal to said washer containing said batch of fabric after sending said entry signal and said exit signal whereby said trap door is opened upon receiving said open signal.

3. The apparatus of claim 1 wherein said means for supporting said trap door comprises:

a yoke having two parallel legs and a joining leg perpendicular to said parallel legs;

one end of each parallel leg distal from said joining leg rotatably attached to a side of said tub opposite said end of said other parallel leg;

a piston drive mounted on said joining leg of said yoke and coupled to said trap door in an operable arrangement whereby, when a piston of said piston drive is retracted, said trap door is withdrawn from said opening in said trap door and when said piston is extended, said piston forces said door against said opening in said tub.

a pneumatic drive means mounted on a side of said tub and coupled to said yoke in operable combination to swing said trap door coupled to said yoke away from said opening enabling a fabric batch in said tub to fall through said opening in said tub onto said conveyor belt means.

4. The apparatus of claim 3 wherein said agitator means comprises:

said tub being substantially cylindrical and having a centerline;

a pair of aligned shafts;

means for rotatably supporting far ends of said shafts on said frame and an end of each shaft abuttedly secured to a side of said tub and perpendicularly intersecting said centerline of said tub;

agitator drive means mounted on said frame and coupled to said tub in an operable arrangement to enable said agitator drive means to cause said tub to rotatably swing on said shafts.

5. The apparatus of claim 4 wherein said agitator drive means comprises one of:

(i) a motor;

(ii) a solenoid:

(iii) a pneumatic drive;

(iv) a hydraulic drive.

6. The apparatus of claim 3 wherein said piston drive comprises one of:

(i) a motor;

(ii) a solenoid:

(iii) a pneumatic drive;

(iv) a hydraulic drive.

7. The apparatus of claim 1 wherein said means for supporting said trap door comprises;

a hinge coupling an edge of said door panel to and edge of opening in said tub;

a lever having one end attached to an edge of said door panel;

a trap door actuator having an arm with an end coupled to another end of said lever providing that when said actuator receives said open signal from said controller said trap door actuator opens said trap door.

8. The apparatus of claim 3 wherein said trap door further comprises:

a clamp drive having a clamp bar;

said clamp bar arranged in operable combination with said door panel that said clamp drive when actuated forces an end of said clamp bar to slide in an incline direction over said door panel whereby said door panel is forced against said opening of said tube.

9. The apparatus of claim 1 wherein said conveyor belt means comprises an elevator means for lifting said batch of fabric from said conveyor belt means to a location where said batch of fabric falls into said extractor.

10. The apparatus of claim 9 wherein said conveyor means comprises:

one belt loop mounted on one pair of pulley wheels at an end of said conveyor belt adjacent said extractor and another belt loop mounted on another pair of pulley wheels at an end of said conveyor belt adjacent said extractor;

said one pair of pulley wheels with one belt being on one side of said conveyor belt means and said another pair of pulley wheels with said another belt being on an opposite side of said conveyor belt means;

one of said pulley wheels supported above another of said pulley wheels;

a tray having one edge rotatably secured to one of said pulley belts and an opposite edge rotatably secured to said another belt;

said tray and belt loops and pulley wheels arranged in operable combination with one another to provide that said tray is oriented horizontally and is movable between a lower where a laundry load falling off an end of said conveyor belt means falls on said tray and an upper location where said laundry load falls into an opening in said extractor when said tray is tipped from said horizontal orientation;

tip means for engaging said tray and tipping said tray when said tray is lifted to said upper location;

elevator drive means coupled to said pulley wheels for moving said tray between said lower location and said upper location;

said elevator drive means being responsive to a lift signal.

11. The apparatus of claim 10 comprising a controller arranged to generate said lift signal.

12. The apparatus of claim 9 wherein said elevator means comprises an inclined conveyor 0belt arranged at an end of said conveyor belt means to receive a batch of fabric from said conveyor belt means, raise said batch along an incline to a height required to dump said load of fabric into said extractor, and dump said batch of fabric into said extractor.

13. The apparatus of claim 1 comprising:

said tub being cylindrical;

a pair of aligned shafts;

each shaft having one end abuttingly secured to an outside surface of said tub perpendicular to a center line of said tub;

a pair of journal bearings;

each shaft journaled into one of said journal bearings;

means for supporting each said bearing on said frame.

14. The apparatus of claim 13 wherein said means for supporting each said bearing is a resilient member.

15. The apparatus of claim 14 wherein said resilient member is a spring.

16. The apparatus of claim 14 wherein said resilient member has a stiffness constant selected in operable combination with a weight of said tub and water in said tub and said laundry in said tub to provide that said resilient member, tub water and laundry load execute resonant motion when said agitator means agitates said tub at a resonant frequency.

17. The apparatus of claim 14 wherein said resilient member is an air cushion.

18. The apparatus of claim 17 further comprising an air valve for admitting pressurized air from a source to said air cushion;

said agitator means is constructed to be driven by electrical power;

a controller means connected to said valve and to said agitator means for adjusting pressure of air delivered by said valve to said air cushion to where said power is minimized.

19. The apparatus of claim 18 wherein said agitator means comprises a motor linked by a lever arm to said tub.

20. The apparatus of claim 1 wherein said extractor comprises:

an outer cylinder an inner cylinder having perforations and rotatably concentrically mounted in said outer cylinder;

a rotating drive means mounted on said outer cylinder operably arranged and coupled to said inner cylinder to spin said inner cylinder about a centerline of said outer and inner cylinders;

said inner and outer cylinders each having a top opening for depositing a batch of fabric in said inner cylinder:

means for tilting said said inner and outer cylinders when said inner cylinder is spinning.

21. The apparatus of claim 20 wherein said means for tilting comprises:

a pair of aligned shafts perpendicular to the center line of said outer cylinder intermediate ends of said outer cylinder and each having an end abuttably secured to said outer cylinder;

said aligned shafts having distal ends rotatably mounted on said frame in an operable arrangement to permit said cylinder to be tilted on said shafts when said inner cylinder is spinning.

22. The apparatus of claim 21 which comprises:

a controller means for controlling said rotating means to spin said inner cylinder at a rate selected to distribute said batch evenly in said inner cylinder when said centerline is horizontal and then to spin said inner cylinder at a rate selected to remove liquid from said batch by centrifugal force through said perforations when said centerline is vertical.

23. The apparatus of claim 1 wherein said agitating means comprises:

a lever arm;

a fulcrum base supporting said lever arm between ends of said lever arm;

said tub being suspended on one end of said lever arm;

a weight suspended on an another end of said lever arm and selected to balance said lever;

means for driving said lever arm to oscillate in a vertical plane.

24. The apparatus of claim 1 wherein said agitating means comprises:

a pair of shafts aligned with one another and having outer ends supported each on one of a pair of air cushions and having inner ends facing one another;

said tub secured to said shafts between said inner ends with a centerline of said tub perpendicularly intersecting a common centerline of said shafts;

outer ends of said shafts operably mounted on said air cushions to permit said tub to rotably oscillate about said common centerline;

a drive motor arranged to drive a camshaft;

said cam shaft operably coupled to said tub to provide that said tub rotatably oscillates when said camshaft is driven by said motor.

* * * * *